US007678230B2

(12) United States Patent
Shannon et al.

(10) Patent No.: US 7,678,230 B2
(45) Date of Patent: Mar. 16, 2010

(54) ENVIRONMENTALLY SUSTAINABLE MULTIPLE PLY PAPER PRODUCT

(75) Inventors: Thomas Gerard Shannon, Neenah, WI (US); Benjamin Joseph Kruchoski, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 493 days.

(21) Appl. No.: 11/639,802

(22) Filed: Dec. 15, 2006

(65) Prior Publication Data

US 2008/0142177 A1 Jun. 19, 2008

(51) Int. Cl.
*D21F 11/00* (2006.01)

(52) U.S. Cl. ..... 162/129; 162/147; 162/123; 428/153

(58) Field of Classification Search ..... 162/129, 162/147, 123; 428/153
See application file for complete search history.

(56) References Cited

U.S. PATENT DOCUMENTS

| | | | | |
|---|---|---|---|---|
| 3,301,746 | A * | 1/1967 | Sisson et al. | 162/113 |
| 3,905,863 | A * | 9/1975 | Ayers | 162/113 |
| 3,940,529 | A | 2/1976 | Hepford et al. | |
| 4,100,017 | A | 7/1978 | Flautt, Jr. | |
| 4,919,877 | A | 4/1990 | Parsons et al. | |
| 5,405,501 | A | 4/1995 | Phan et al. | |
| 5,906,711 | A | 5/1999 | Barnholtz | |
| 5,919,556 | A | 7/1999 | Barnholtz | |
| 6,054,020 | A | 4/2000 | Goulet et al. | |
| 6,136,422 | A | 10/2000 | Lichtenberg et al. | |
| 6,190,500 | B1 | 2/2001 | Mohan et al. | |
| 6,332,952 | B1 | 12/2001 | Hsu et al. | |
| 6,573,203 | B1 | 6/2003 | McConnell et al. | |
| 6,649,052 | B2 | 11/2003 | Lee et al. | |
| 6,896,766 | B2 | 5/2005 | Sarbo et al. | |
| 6,936,136 | B2 | 8/2005 | Shannon et al. | |
| 2003/0168191 | A1 * | 9/2003 | Hansen et al. | 162/129 |
| 2003/0196772 | A1 | 10/2003 | Awofeso et al. | |
| 2006/0042767 | A1 * | 3/2006 | Bhat et al. | 162/117 |
| 2006/0093788 | A1 | 5/2006 | Behm et al. | |

FOREIGN PATENT DOCUMENTS

| | | |
|---|---|---|
| DE | 19534812 | 3/1997 |

OTHER PUBLICATIONS

International Search Report.
Tappi T 411 om-89; Thickness (caliper) of paper, paperboard, and combined board; 1989 (3 pages).
Tappi T 402 om-93; Standard conditioning and testing atmospheres for paper, board, pulp handsheets, and related products; 1993 (3 pages).
Tappi T-410 om-98; Grammage of paper and paperboard (weight per unit area); 1998 (5 pages).

* cited by examiner

*Primary Examiner*—Mark Halpern
(74) *Attorney, Agent, or Firm*—Dority & Manning, P.A.

(57) ABSTRACT

The present disclosure is generally directed to a multiple ply paper product which includes a first ply comprising virgin fiber, pre-consumer recycled fiber, or mixtures thereof and a second ply comprising at least about 30% by weight post-consumer recycled fiber, wherein the average pore size distribution of the first ply is greater than the average pore size distribution of the second ply.

19 Claims, No Drawings

ENVIRONMENTALLY SUSTAINABLE MULTIPLE PLY PAPER PRODUCT

BACKGROUND

Products made from paper webs such as bath tissues, facial tissues, paper towels, industrial wipers, food service wipers, napkins, medical pads and other similar products are designed to include certain properties. For example, such products can have a relatively soft feel and, for most applications, can be highly absorbent. While such features are of importance, environmental sustainability is also rapidly becoming a desired feature in consumer products.

For paper products, a component of an environmentally sustainable product is the use of recycled fiber. Although a high level of recycled fiber is desirable from an environmental viewpoint, the incorporation of recycled fiber, particularly post-consumer recycled fiber, can create significant problems in the properties of the end product.

For instance, while paper products containing high levels of recycled fiber are commercially available, such paper products exhibit much poorer absorbency characteristics than products with little or no recycled fiber. As a result, such products perform marginally for tasks in which paper products are generally employed.

The closed pore structure of products made with recycled fiber, particularly post-consumer recycled fiber, contributes to the limited absorbency of such products. Still, recycled fiber can be utilized advantageously in certain applications. For example, in cleaning glass, the closed pore structure of products made with recycled fiber can provide for reduced streaking of the glass. Nonetheless, the low absorbent capacity of products made with recycled fiber results in poor initial wiping and hinders the overall performance of the products.

As such, a need exists for paper products containing high levels of recycled fiber, particularly post-consumer recycled fiber, which also have performance attributes that are preferable relative to products that do not contain high levels of recycled fiber and wherein, the improved performance benefit of such product is due to the properties imparted by the recycled fiber.

SUMMARY

The present disclosure is directed to tissue products having enhanced environmental sustainability while providing consumer preferred benefits with regard to overall product attributes currently valued by consumers. Objects and advantages of the disclosure will be set forth in part in the following description, or may be obvious from the description, or may be learned through the practice of the disclosure.

The present disclosure is generally directed to a multiple ply paper product which includes a first ply comprising virgin fiber, pre-consumer recycled fiber, or mixtures thereof and a second ply comprising at least about 30% by weight post-consumer recycled fiber, wherein the average pore size distribution of the first ply is greater than the average pore size distribution of the second ply.

In certain embodiments, the second ply may comprise at least about 50% by weight post-consumer recycled fiber. The second ply may comprise at least about 80% by weight post-consumer recycled fiber. The second ply may comprise 100% by weight post consumer recycled fiber. The first ply may comprise at least about 50% by weight pre-consumer recycled fiber. The second ply may have an average absorbent capacity of from about 1 g/g to about 7 g/g. The second ply may have an average absorbent capacity of from about 2 g/g to about 5 g/g. The first ply may have an average absorbent capacity of from about 6 g/g to about 9 g/g. The second ply may have an average absorbent capacity of from about 7 g/g to about 8 g/g. The third play may comprise virgin fiber, pre-consumer recycled fiber, or mixtures thereof. The second play may be located between the first ply and the second ply. The first play may comprise a through air dried sheet of 100% virgin fiber. The second ply may comprise a creped wet pressed sheet. The basis weight of the first web may be from about 90% to about 40% of the basis weight of the second web.

In another exemplary embodiment, a multiple ply paper product is disclosed which includes a first ply comprising virgin fiber, pre-consumer recycled fiber, or mixtures thereof, a second ply comprising at least about 30% by weight post-consumer recycled fiber, and a third ply comprising virgin fiber, pre-consumer recycled fiber, or mixtures thereof, wherein the average pore size distribution of the first ply is greater than the average pore size distribution of the second ply and the average pore size distribution of the third ply.

In still another exemplary embodiment of the present disclosure, a process for producing a multiple ply paper product is disclosed which includes forming a first ply paper web comprising at least about 30% by weight post-consumer recycled fiber, and joining the first ply paper web to a second ply paper web comprising virgin fiber, pre-consumer recycled fiber, or mixtures thereof, wherein the average pore size distribution of the first ply is greater than the average pore size distribution of the second ply.

Other features and aspects of the present disclosure are discussed in greater detail below.

DETAILED DESCRIPTION

It is to be understood by one of ordinary skill in the art that the present discussion is a description of exemplary embodiments only, and is not intended as limiting the broader aspects of the present disclosure, which broader aspects are embodied in the exemplary construction.

The present disclosure is generally directed to a multiple ply paper product and methods for making the same. In particular, the present disclosure is applicable to multiple ply paper products containing recycled fiber. The multiple ply paper products of the present disclosure are made by combining at least two different paper webs. A first web can include virgin fiber, pre-consumer recycled fiber, or mixtures thereof. A second web can include high levels of post-consumer recycled fiber.

Paper products as described in this disclosure are meant to include paper products made from base webs such as bath tissues, facial tissues, paper towels, industrial wipers, food-service wipers, napkins, medical pads, and other similar products.

Tissue products can be differentiated from other paper products in terms of their bulk. The bulk of the tissue products of the present disclosure may be calculated as the quotient of the caliper expressed in microns, divided by the basis weight, expressed in grams per square meter. The resulting bulk is expressed as cubic centimeters per gram. Writing papers, newsprint and other such papers have higher strength, stiffness and density (low bulk) in comparison to tissue products of the present disclosure which tend to have much higher calipers for a given basis weight. The multi-ply tissue products of the present disclosure have a bulk that can range between about 2 $cm^3/g$ to about 20 $cm^3/g$, more specifically between about 3 $cm^3/g$ to about 20 $cm^3/g$, and still more specifically between about 4 $cm^3/g$ to about 18 $cm^3/g$.

The bulk of the individual sheets making up the multi-ply product may or may not be the same, however, each of the individual sheets making up the multiply tissue product will have a bulk greater than about 2 cubic centimeters per gram or greater and more specifically from about 3 cubic centimeters per gram to about 24 cubic centimeters per gram, more specifically from about 4 cubic centimeters per gram to about 16 cubic centimeters per gram.

Single sheet bulk is calculated by taking the single sheet caliper and dividing by the conditioned basis weight of the product. The term "caliper" as used herein is the thickness of a single tissue sheet, and may either be measured as the thickness of a single tissue sheet or as the thickness of a stack of ten tissue sheets and dividing the ten tissue sheet thickness by ten, where each sheet within the stack is placed with the same side up.

Caliper is expressed in microns. Caliper is measured in accordance with TAPPI test methods T402 "Standard Conditioning and Testing Atmosphere For Paper, Board, Pulp Handsheets and Related Products" and T411 om-89 "Thickness (caliper) of Paper, Paperboard, and Combined Board" optionally with Note 3 for stacked tissue sheets. The micrometer used for carrying out T411 om-89 is a Bulk Micrometer (TMI Model 49-72-00, Amityville, N.Y.) or equivalent having an anvil diameter of 4 1/16 inches (103.2 millimeters) and an anvil pressure of 220 grams/square inch (3.3 g kilo Pascals.) For the multi-ply products of the present disclosure the single sheet bulk is determined by deplying the sheets before measuring the caliper and basis weight as defined.

The basis weight and bone dry basis weight of the tissue sheet specimens are determined using TAPPI T410 procedure or a modified equivalent such as: Tissue samples are conditioned at 23° C.±1° C. and 50±2% relative humidity for a minimum of 4 hours. After conditioning a stack of 16—3"×3" samples is cut using a die press and associated die. This represents a tissue sheet sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram on a tared analytical balance. The basis weight in grams per square meter is calculated using the following equation:

$$\text{Basis weight} = \text{stack wt. in grams}/0.0929$$

Post-consumer recycled fiber is sourced from end products generated by consumers where such end products have been separated or diverted from the solid waste stream. Examples of post-consumer recycled fiber can include, without limitation, office wastepaper, junk mail, magazines, undeliverable mail, shipping packaging, and the like. Pre-consumer recycled fiber is sourced from materials that have not met their intended end-use by a consumer. Examples of such materials can include, without limitation, manufacturing waste, mill scraps, pre-consumer deinking material, pulp substitutes, and the like. Pre-consumer recycled fiber does not, however, include mill broke defined as paper or paperboard scrap generated in a mill prior to completion of the manufacturing process which is unsuitable for subsequent applications but can be utilized in the paper manufacturing process. Virgin fiber refers to wood or other cellulose fiber that has not been previously used in the paper making process.

In certain embodiments, the multiple ply paper product of the present disclosure can include at least one first web with at least about 30% by weight pre-consumer recycled fiber. In other embodiments, the multiple ply paper product of the present disclosure can include a web with at least about 50% by weight pre-consumer recycled fiber. In still other embodiments, the multiple ply paper product of the present disclosure can include a web with at least about 70% by weight pre-consumer recycled fiber. In still other embodiments, the multiple ply paper product of the present disclosure can include a web with 100% by weight pre-consumer recycled fiber. A feature of said first web is that said web contains little or no post-consumer recycled fiber. In general, the range of post-consumer recycled fiber in said first web is less than 20% and still more preferably less than 10% and most preferably around 0% by weight.

In some embodiments, said at least one first web of the multiple ply paper product of the present disclosure can include a web with at least about 30% by weight virgin fiber. In other embodiments, the multiple ply paper product of the present disclosure can include a web with at least about 50% by weight virgin fiber. In still other embodiments, the multiple ply paper product of the present disclosure can include a web with at least about 70% by weight virgin fiber. In still other embodiments, the multiple ply paper product of the present disclosure can include a web with 100% by weight virgin fiber.

The multiple ply paper product of the present disclosure includes at least one second web, said at least one second web comprising at least about 50% by weight post-consumer recycled fiber. In other embodiments, the at least one second web of the multiple ply paper product of the present disclosure can include a web with at least about 70% by weight post-consumer recycled fiber. In still other embodiments, the at least one second web of the multiple ply paper product of the present disclosure can include a web with at least about 90% by weight post-consumer recycled fiber.

As stated previously, the multiple ply paper product of the present disclosure is formed by combining at least two different paper webs. An at least one first web can include virgin fiber, pre-consumer recycled fiber, or mixtures thereof and an at least one second web can include post-consumer recycled fiber. The first web and second web can form the outer layers of a multiple ply paper product. The basis weight, calipers and bulk of the first web and second web can be the same or different as would be understood by one of ordinary skill in the art.

In certain embodiments, the multiple ply paper product of the present disclosure also includes a third web that can include virgin fiber, pre-consumer recycled fiber, or mixtures thereof. The third web may be different or the same as the at least one first web or the at least one second web. The second web can be located between the first web and third web. In addition, the first web and third web can form the outer layers of a multiple ply paper product. The basis weight of the third web can be the same or different from the first web and the second web.

In certain embodiments, the second web can have a smaller pore structure than the first web and/or third web. As such, the average pore size distribution of the first web and/or third web is greater than the average pore size distribution of the second web.

In this regard, in some embodiments, the first web and/or third web can have an average absorbent capacity of from about 6 g/g to about 9 g/g. In some embodiments, the first web and/or third web can have an average absorbent capacity of from about 7 g/g to about 8 g/g. In certain embodiments, the second web can have an average absorbent capacity of from about 1 g/g to about 7 g/g. In some embodiments, the second web can have an average absorbent capacity of from about 2 g/g to about 5 g/g.

For example, in a two ply embodiment of the present disclosure, a first web comprising virgin fiber, pre-consumer recycled fiber, or mixtures thereof which can rapidly absorb liquid is combined with a second web comprising a high level of post-consumer recycled fiber. The product of this example may preferably be utilized for glass cleaning wherein the side of the product comprising the first web is first used to remove the majority of liquid and wherein the window is next wiped with the side of the product comprising said second web to remove any remaining traces of liquid while preventing streaking. Such a product may be made available to the consumer in a rolled, folded or sheet form as well known in the art. In another embodiment, a visual or cue is provided in the product to enable the consumer to distinguish said first and second sides of said multi-ply product. Said cue may consist of a coloration difference, a printing difference, embossing difference or any other means well known in the art. The means by which the plies are attached to each other is not overly critical to the disclosure and may be done by any means known in the art, including but not limited to pin embossing, crimping, glue nested embossing and the like.

In a specific example of this embodiment said first web comprises a through air dried sheet comprising virgin fibers or pre-consumer recycled fibers, preferably all virgin fibers. Through air dried sheets are known for their advantages relative to high absorbent capacity and absorbent rate. Through air dried sheets can also attain these absorbent capacities and rates with less fiber due to superior bulk generation. Said second web comprises a creped wet pressed sheet comprising at least about 50% by weight post consumer recycled fiber, more specifically at least about 65% by weight post consumer recycled fiber and still more specifically about 80% by weight post consumer recycle fiber. The remaining portion of said second web may comprise virgin, synthetic or pre-consumer recycle fiber and mixtures thereof. Most preferably, the portion of said second web not comprising post-consumer recycled fiber is composed of pre-consumer recycled fiber such that said second web comprises greater than 95% by total weight recycled fiber. In a specific example said second web comprises 100% recycled fiber excluding any chemicals and other additives which may be present in small amounts to impart desired properties to said sheet.

In a further specific embodiment of said two ply product, said first web is comprised of a through air dried sheet having a lower basis weight that said second web comprising the post-consumer recycled fiber. In this manner maximum environmental sustainability can be balanced with maximum performance. Specifically in this embodiment said first web has a basis weight of from about 60% to about 10% less than said second web, more specifically from about 50% to about 15% less and still more specifically from about 40% to about 20% less than said second web.

In a three ply embodiment, a second web which includes post-consumer recycled fiber can be positioned between a first web and a third web which include virgin fiber, pre-consumer recycled fiber, or mixtures thereof. In a preferred embodiment said first and third web are the same. In a specific embodiment said first and third webs are comprised of 100% virgin fibers comprising a mixture of hardwood and softwood fibers. In a further specific embodiment the first and third web comprise at least two layers wherein at least one of the outermost layers of said first or third web comprises primarily hardwood fibers and wherein at least one other layer of said web comprises primarily softwood fibers. In the multi-ply product of this embodiment said first and third webs are preferably arranged such that the outermost facing layers of said first and third webs of the multi-ply product are layers comprising primarily hardwood fibers with said second web of the multi-ply product residing between said first and third web. The second web comprises a high level of post consumer recycled fiber and can have a wet out time that is higher than either the first web or third web.

In one example of the three ply product, said second web comprises a creped wet pressed sheet comprising at least about 50% by weight post consumer recycled fiber, more specifically at least about 65% by weight post consumer recycled fiber and still more specifically about 80% by weight post consumer recycle fiber. The remaining portion of said second web may comprise virgin, synthetic or pre-consumer recycle fiber and mixtures thereof. Most preferably, the portion of said second web not comprising post-consumer recycled fiber is composed of pre-consumer recycled fiber such that said second web comprises greater than 95% by total weight recycled fiber. In a specific example said second web comprises 100% recycled fiber excluding any chemicals and other additives which may be present in small amounts to impart desired properties to said sheet.

Said three ply tissue products are suitable for use as facial tissue and more specifically may be well suited for use as premium facial tissues. While a key property of facial tissue is softness, another sought after property is hand protection, that is the prevention of nasal mucous from migrating through the tissue and contacting the hand. In the three ply example of the present disclosure, the tactile harshness of the second web can be mitigated by the tactile softness of the first web and third web which prevent contact of the second web with the skin. At the same time, said second web provides a barrier preventing penetration of nasal mucous or other fluids through the product and contacting the hand. In this manner, the product of the present disclosure can have both a high level of post consumer recycled fiber yet retains its softness as well as a value added benefit of increased hand protection.

In another specific embodiment of said three ply product, the said second web comprising the post-consumer recycled fiber has a geometric mean tensile strength less than or equal to the geometric mean tensile strength of said first and third webs. In this manner, any stiffness which may be imparted by said second web due to the incorporation of post-consumer fibers is reduced. Said tensile strength reduction may be accomplished by any means known in the art including the use of chemical debonders to weaken and reduce the stiffness of said web. Specifically the geometric mean tensile strength of said second web may be from about 0 to about 50% less than the geometric mean tensile strength of said first or third web and more specifically from about 0 to about 40% less than the geometric mean tensile strength of said first or third web.

Another means of reducing stiffness of the web is to decrease the caliper of the web. Hence, in another specific embodiment of the three ply execution of the present disclosure the caliper of said second web is less than the caliper of said first and third webs. More specifically the caliper of said second web may be from about 0% to about 50% less than the caliper of said first and third webs, more specifically from about 0% to about 40% and most specifically from about 0% to about 30% less than the caliper of said first or third web. Despite the caliper difference, the basis weights of the first, second and third webs may be the same or different. Most preferably the basis weight of the second web is about the same or greater than the basis weight of the second web.

The total amount of post-consumer recycle fiber in the three ply multi-ply product may vary but is preferably from about 20% to about 50% or greater such as from about 20% to about 75% more specifically from about 20% to about 70% and more specifically from about 30% to about 60% based on the weight of total fibers in the 3-ply multi-ply sheet. In a specific embodiment, said three ply product contains 100% by weight recycled fiber based on total weight of fiber, said second web comprising all post consumer recycle fiber and said first and third webs comprising all pre-consumer recycle fiber.

The wet out time of the second web is preferably greater than the wet out time of the first and third webs. More specifically the wet out time of the second web is from about 50% to about 1000% or more than the wet out time of the first or third web. More specifically the wet out time of the second web is from about 100% to about 800% more and still more specifically from about 100% to about 600% greater than the first or third web. Wet out times for said second web may range from about 8 seconds to about 300 seconds or greater such as from about 10 seconds to about 300 seconds such as from about 15 seconds to about 200 seconds or more.

The Wet Out Time of a tissue web of the present disclosure is determined by cutting 20 sheets of the sample of the tissue sheet and/or tissue product into 2.5 inch squares. The number of sheets of the sample of tissue sheet and/or tissue product used in the test is independent of the number of plies per sheet of the sample of the tissue sheet and/or tissue product. The 20 square sheets of the sample of the tissue sheet and/or tissue product are stacked together and stapled at each corner to form a pad of the sample of the tissue sheet and/or tissue product. The pad of the sample of the tissue sheet and/or tissue product is held close to the surface of a constant temperature distilled water bath (23° C.±2° C.), which is the appropriate size and depth to ensure the saturated pad of the sample of the tissue sheet and/or tissue product does not contact the bottom of the water bath container and the top surface of the distilled water of the water bath at the same time, and dropped flat onto the surface of the distilled water, with staple points on the pad of the sample of the tissue sheet and/or tissue product facing down. The time necessary for the pad of the sample of the tissue sheet and/or tissue product to become completely saturated, measured in seconds, is the Wet Out Time for the tissue sheet sample and represents the absorbent rate of the sample of the tissue sheet and/or tissue product. Increases in the Wet Out Time represent a decrease in absorbent rate of the sample of the tissue sheet and/or tissue product. The test is stopped at 300 seconds with any sheet not wetting out in that period given a value of about 300 seconds or greater. When determining the wet out times of the individual webs making up the multi-ply product the individual webs are separated and stacked and measured independently. The webs may be separated either before or after cutting the sample specimen.

It should be appreciated that variations in the process for producing the multiple ply paper product of the present disclosure can be made without departing from the scope and spirit of the disclosure. In certain embodiments, an uncreped throughdried process is useful for making basesheets suitable for purposes of this disclosure. In this regard, a twin wire former having a papermaking headbox can inject or deposit a stream of an aqueous suspension of papermaking fiber onto a plurality of forming fabrics, such as an outer forming fabric and an inner forming fabric, thereby forming a wet tissue web. The forming process of the present disclosure can be any conventional forming process known in the papermaking industry. Such formation processes include, but are not limited to, Fourdrinier formers, roof formers such as suction breast roll formers, and gap formers such as twin wire formers and crescent formers.

A wet tissue web can be formed on the inner forming fabric as the inner forming fabric revolves about a forming roll. The inner forming fabric serves to support and carry the newly-formed wet tissue web downstream in the process as the wet tissue web is partially dewatered to a consistency of about 10 percent based on the dry weight of the fiber. Additional dewatering of the wet tissue web can be carried out by known paper making techniques, such as vacuum suction boxes and the like, while the inner forming fabric supports the wet tissue web. The wet tissue web may be additionally dewatered to a consistency of at least about 20 percent, more specifically between about 20 to about 40 percent, and more specifically about 20 to about 30 percent. The wet tissue web is transferred from the inner forming fabric to a transfer fabric traveling preferably at a slower speed than the inner forming fabric in order to impart increased stretch into the wet tissue web. This is commonly referred to as a "rush" transfer. The rush transfer is maintained at an appropriate level to ensure the right combination of stretch and strength in the finished product. Depending on the fabrics utilized and the post-tissue-machine converting process, the rush transfer should be in the range of from about 10 to about 25 percent.

The wet tissue web can be transferred from the transfer fabric to a throughdrying fabric whereby the wet tissue web may be macroscopically rearranged to conform to the surface of the throughdrying fabric with the aid of a vacuum transfer roll or a vacuum transfer shoe like the vacuum shoe. If desired, the throughdrying fabric can be run at a speed slower than the speed of the transfer fabric to further enhance stretch of the resulting absorbent sheet. The transfer can be carried out with vacuum assistance to ensure conformation of the wet tissue web to the topography of the throughdrying fabric.

While supported by the throughdrying fabric, the wet tissue web can be dried to a final consistency of about 94 percent or greater by a throughdryer and is thereafter transferred to a carrier fabric. Alternatively, the drying process can be any non-compressive drying method that tends to preserve the bulk of the wet tissue web.

The dried tissue web can be transported to a reel using a carrier fabric and an additional optional carrier fabric. An optional pressurized turning roll can be used to facilitate transfer of the dried tissue web from the carrier fabric. If desired, the dried tissue web can be additionally embossed to produce a pattern on the absorbent tissue product produced using the throughdrying fabric and a subsequent embossing stage.

Once the wet tissue web has been non-compressively dried, thereby forming the dried tissue web, it is possible to crepe the dried tissue web by transferring the dried tissue web to a Yankee dryer prior to reeling, or using alternative foreshortening methods such as micro-creping as disclosed in U.S. Pat. No. 4,919,877 issued on Apr. 24, 1990 to Parsons et al., herein incorporated by reference.

In certain embodiments, the wet tissue web can be transferred directly from the inner forming fabric to a throughdrying fabric, thereby eliminating the transfer fabric. The throughdrying fabric can be traveling at a speed less than the inner forming fabric such that the wet tissue web is rush transferred or, in the alternative, the throughdrying fabric can be traveling at substantially the same speed as the inner forming fabric.

In certain embodiments, a flexible polymeric binder material can be applied to one or both surfaces of a throughdried basesheet. Gravure printing of the binder can be utilized, as can other means of applying a flexible polymeric binder material including foam application, spray application, flexographic printing, or digital printing methods such as ink jet printing and the like. A flexible polymeric binder material can be applied to a sheet in a pre-selected pattern. After the flexible polymeric binder material is applied, the sheet can be adhered to a creping roll by a press roll. The sheet is carried on the surface of the creping roll for a distance and then removed therefrom by the action of a creping blade. The creping blade performs a controlled pattern creping operation on the side of the sheet to which the flexible polymeric binder material was applied.

Once creped, the sheet can pulled through an optional drying station. The drying station can include any form of a heating unit, such as an oven energized by infrared heat, microwave energy, hot air or the like. Alternatively, the drying station may comprise other drying methods such as photocuring, UV-curing, corona discharge treatment, electron beam curing, curing with reactive gas, curing with heated air such as through-air heating or impingement jet heating, infrared heating, contact heating, inductive heating, microwave or RF heating, and the like. The drying station may be necessary in some applications to dry the sheet and/or cure the flexible polymeric binder material materials. Depending upon the flexible polymeric binder material selected, however, a drying station may not be needed. Once passed through the drying station, the sheet can be wound into a roll of material.

Both creped and uncreped throughdried webs are suitable for webs made in accordance with the present disclosure. However, when using a throughdryer, a relatively low topography fabric should be used in order to form a smooth surface on the web.

The manner in which one paper web is laminated to another paper web will depend upon the structure of the webs and the particular application. In most applications, a binder material, such as an adhesive or binder fiber, is applied to one or both webs in order to join the webs together. The adhesive can be, for instance, a latex adhesive, a starch-based adhesive, an acetate such as an ethylene vinyl acetate adhesive, a polyvinyl alcohol adhesive, and the like. It should be understood, however, that other binder materials, such as thermoplastic films and fiber can also be used to join the webs. For many applications, the binder material should be spread evenly over the surfaces of the web in order to securely attach the webs together.

In certain embodiments, one or both of the webs can be embossed prior to adhesively attaching the webs together. Once embossed, the webs can be nested or in a pin-to-pin arrangement. A "pin-to-pin" refers to laminating together two embossed plies in which the raised or embossed areas of each ply contact each other.

In certain embodiments, a paper web is embossed by an embossing roll and fed through an adhesive application station. The adhesive application station is an offset printer in which a first roller is dipped into an adhesive. The adhesive is transferred to a second roller and then to a third roller before being applied to the paper web. It should be understood, however, that the adhesive can be applied to the web in other ways, such as by spraying.

Once the adhesive is applied to a paper web, the paper web is joined to another paper web by a pair of press rollers. Once joined together, a laminate is formed.

In certain embodiments, both of the paper webs are embossed prior to being laminated together. For instance, a paper web can be fed through an embossing roll while another paper web is also embossed by the embossing roll and coated with an adhesive at an adhesive station. Once the adhesive is applied, the paper webs are mated by press rollers. Depending upon the pattern embossed into the webs and the relative position of the webs, the webs can be joined in a nested relationship or in a pin-to-pin relationship.

In certain embodiments, a process for joining two webs together in a non-nested pin-to-pin or random pin-to-pin relationship can be utilized. The paper webs are embossed by embossing rolls. The paper webs are brought in to contact with the embossing rolls by press rolls. The embossing rolls have embossing knuckles extending outwardly from their circular periphery, and the press rolls each have an elastomer cylindrical cover. The embossing rolls are positioned with respect to each other to mesh the knuckles on the upper embossing roll with the knuckles on the lower embossing roll.

The paper webs are fed into the nip formed by the two embossing rolls. Once fed into the nip, the webs are subjected to the knuckles on the embossing rolls. As described above, the knuckles are positioned with respect to each other to mesh such that the knuckles on the embossing rolls are offset. The contact between the knuckles is made with sufficient force to mechanically work the two webs together and join them. Although not necessary, one of the webs can be contacted with an adhesive at an adhesive station. The adhesive can be applied through spraying.

When using an adhesive, the adhesive can be applied evenly over one or more surfaces of the plies or can be applied at selected locations. Further, besides the use of adhesives, is should be understood that other binder materials can be used. For example, binder fiber can be applied in between the plies for bonding the plies together. When using binder fiber, the plies are heated and thermally bonded together by melting at least a portion of the binder fiber.

In certain embodiments, the webs may be mechanically attached together. For instance, fiber entanglement from one ply to the next is sufficient in forming the product. Fiber crimping techniques can also be used to create a mechanical interlocking bond.

Besides the above methods for joining the webs, it should be understood that any suitable manner for joining two or more webs together can be used in the present disclosure. For example, various methods for attaching webs together are disclosed in U.S. Pat. No. 3,940,529 to Hepford et al., U.S. Pat. No. 4,100,017 to Flautt, and U.S. Pat. No. 6,136,422 to Lichtenberg, et al., which are all incorporated herein by reference.

In addition, two or more webs can be joined together using the above-described methods. It should also be understood that regardless of the method selected for joining two or more webs together, the webs can be joined together in specific locations. For instance, the webs can be joined only in the MD direction on the outer edges of the webs so as to form a pocket suitable to cover the hand of a wearer or an apparatus which the product covers. Preferably, a means to discern the two sides of the product is provided such that a consumer is readily informed as to which side of the product to use first.

Generally, a wide variety of natural and synthetic pulp fiber are suitable for use in the multiple ply products of this disclosure. The pulp fiber may include fiber formed by a variety of pulping processes, such as kraft pulp, sulfite pulp, thermomechanical pulp, etc. In addition, the pulp fiber may consist of any high-average fiber length pulp, low-average fiber length pulp, or mixtures of the same. One example of suitable high-average length pulp fiber includes softwood fiber. Softwood pulp fiber is derived from coniferous trees and include pulp fiber such as, but not limited to, northern softwood, southern softwood, redwood, red cedar, hemlock, pine (e.g., southern pines), spruce (e.g., black spruce), combinations thereof, and the like. Northern softwood kraft pulp fiber may be used in the present disclosure. One example of commercially available northern softwood kraft pulp fiber suitable for use in the present disclosure include those available from Kimberly-Clark Corporation located in Neenah, Wis. under the trade designation of "Longlac-19". An example of suitable low-average length pulp fiber is the so called hardwood pulp fiber. Hardwood pulp fiber is derived from deciduous trees and include pulp fiber such as, but not limited to, eucalyptus, maple, birch, aspen, and the like. In certain instances, eucalyptus pulp fiber may be particularly desired to increase the softness of the web. Eucalyptus pulp fiber may also enhance the brightness, increase the opacity, and change the pore structure of the web to increase its wicking ability.

In one embodiment of the disclosure, one or more of the webs of the multiple ply products of the present disclosure is a blended sheet wherein the hardwood pulp fiber and softwood pulp fiber are blended prior to forming the web thereby producing a homogenous distribution of hardwood pulp fiber and softwood pulp fiber in the z-direction of the web.

Optional chemical additives may also be added to the aqueous papermaking furnish or to one or more tissue sheets of the multiple ply paper products of the present disclosure to impart additional benefits to the product and process. Such chemicals may be added at any point in the papermaking process, such as before or after addition of the flexible polymeric binder material.

For example, debonding agents may be applied to the fiber in any or all plies of the sheet. Debonding agents useful for reducing the strength in the sheet(s) include any chemical that diminishes the capability of papermaking fiber to hydrogen bond together, thereby reducing the stiffness of the resulting sheet and increasing perceived softness. Any known in the art debonder can be used to reduce the strength of the sheet. Examples of such chemical debonders include quaternary ammonium compounds, mixtures of quaternary ammonium compounds with polyhydroxy compounds. Examples of quaternary ammonium compounds suitable for use in the present disclosure include dialkyldimethylammonium salts such as ditallow dimethyl ammonium chloride, ditallow dimethylammonium methyl sulfate, and di(hydrogenated)tallow dimethyl ammonium chloride. Particularly suitable debonding agents are 1-methyl-2 noroleyl-3 oleyl amidoethyl imidazolinium methyl sulfate and 1-ethyl-2 noroleyl-3 oleyl amidoethyl imidazolinium ethylsulfate. Suitable commercial chemical debonding agents include, without limitation, Witco Varisoft 6027 and Hercules Prosoft TQ 1003. The debonding agent(s) can be applied anywhere in the process but is preferably applied to the fiber prior to forming the sheet.

Charge promoters and control agents, which are commonly used in the papermaking process to control the zeta potential of the papermaking furnish in the wet end of the process, can also be used. These species may be anionic or cationic, most usually cationic, and may be either naturally occurring materials such as alum or low molecular weight high charge density synthetic polymers typically of molecular weight of about 500,000 or less. Drainage and retention aids may also be added to the furnish to improve formation, drainage and fines retention. Included within the retention and drainage aids are microparticle systems containing high surface area, high anionic charge density materials.

Wet and dry strength agents may also be applied to the web. As used herein, "wet strength agents" refer to materials used to immobilize the bonds between fiber in the wet state. Any material that when added to a sheet results in providing the sheet with a mean wet geometric tensile strength:dry geometric tensile strength ratio in excess of about 0.1 is, for purposes of the present disclosure, termed a wet strength agent. Typically these materials are referred to as permanent wet strength agents or as "temporary" wet strength agents. For the purposes of differentiating permanent wet strength agents from temporary wet strength agents, the permanent wet strength agents will be defined as those resins which, when incorporated into paper or tissue products, will provide a paper or tissue product that retains more than 50 percent of its original wet strength after exposure to water for a period of at least five minutes. Temporary wet strength agents are those which show about 50 percent or less of their original wet strength after being saturated with water for five minutes. Both classes of wet strength agents may find application for the tissue products of the present disclosure. If present, the amount of wet strength agent added to the pulp fiber can be about 0.1 dry weight percent or greater, more specifically about 0.2 dry weight percent or greater, and still more specifically from about 0.1 to about 3 dry weight percent, based on the dry weight of the fiber.

The temporary wet strength agents may be cationic, nonionic or anionic. Such compounds include, without limitation, PAREZ™ 631 NC and PAREZ® 725 temporary wet strength resins that are cationic glyoxylated polyacrylamide available from Cytec Industries (West Paterson, N.J.). Hercobond 1366, manufactured by Hercules, Inc., located at Wilmington, Del., is another commercially available cationic glyoxylated polyacrylamide that may be used in accordance with the present disclosure. Additional examples of temporary wet strength agents include dialdehyde starches such as Cobond® 1000 from National Starch and Chemical Company and other aldehyde containing polymers known in the art.

Suitable permanent wet strength agents include cationic oligomeric or polymeric resins. Polyamide-polyamine-epichlorohydrin type resins, such as KYMENE 557H sold by Hercules, Inc., located at Wilmington, Del., are the most widely used permanent wet-strength agents. Other cationic resins include polyethylenimine resins and aminoplast resins obtained by reaction of formaldehyde with melamine or urea. It is often advantageous to use both permanent and temporary wet strength resins in the manufacture of tissue products of this disclosure.

Suitable dry strength agents include, but are not limited to, modified starches and other polysaccharides such as cationic, amphoteric, and anionic starches and guar and locust bean gums, modified polyacrylamides, carboxymethylcellulose, sugars, polyvinyl alcohol, chitosans, and the like. Such dry strength agents are typically added to a fiber slurry prior to tissue sheet formation or as part of the creping package. While such dry strength agents may be added to the sheets, such dry strength agents increase the strength of the sheet by increasing the amount of hydrogen bonding in the sheet and hence increasing the stiffness of the sheet. Due to the strength developed by the flexible polymeric binder, such dry strength agents are not usually required in the tissue sheets that comprise the polymeric flexible binder material.

In general, the present disclosure may be used in conjunction with any known materials and chemicals that are not antagonistic to its intended use. Examples of such materials and chemicals include, but are not limited to, odor control agents, such as odor absorbents, activated carbon fiber and particles, baby powder, baking soda, chelating agents, zeolites, perfumes or other odor-masking agents, cyclodextrin compounds, oxidizers, and the like. Superabsorbent particles, synthetic fiber, or films may also be employed. Other optional materials include cationic dyes, optical brighteners, absorbency aids and the like. In some applications, the tissue products of this disclosure may be treated with lotions and/or various other additives for numerous desired benefits. For example, formulations containing polysiloxanes may be topically applied to the tissue products in order to further increase the surface softness of the product. A variety of substituted and non-substituted polysiloxanes can be used.

Lotions can also be applied to the tissue products of this disclosure. Suitable lotions can be water-based or oil-based. Suitable water-based compositions include, but are not limited to, emulsions and water-dispersible compositions which can contain, for example, debonders (cationic, anionic or nonionic surfactants), or polyhydroxy compounds such as glycerin or propylene glycol. Oil-based lotions can contain, for instance, a mixture of an oil and a wax. For example, the composition may contain from about 30 to about 90 percent by weight oil and from about 10 to about 40 percent by weight wax. In some embodiments, a fatty alcohol may also be included in an amount from about 5 to about 40 percent by weight. Suitable oils include, but are not limited to, the following classes of oils: petroleum or mineral oils, such as mineral oil and petrolatum; animal oils, such as mink oil and lanolin oil; plant oils, such as aloe extract, sunflower oil and avocado oil; and silicone oils, silicone fluids, silicone emulsions or mixtures thereof. For example, dimethicone and alkyl methyl silicones can be used. Suitable waxes include, but are not limited to, the following classes: natural waxes, such as beeswax and carnauba wax; petroleum waxes, such as paraffin and ceresin wax; silicone waxes, such as alkyl methyl siloxanes; or synthetic waxes, such as synthetic beeswax and synthetic sperm wax or mixtures thereof. Suitable fatty alcohols include alcohols having a carbon chain length of from about 14 to about 30 carbon atoms, including acetyl alcohol, stearyl alcohol, behenyl alcohol, and dodecyl alcohol.

The application point for such materials and chemicals is not particularly relevant to the present disclosure and such materials and chemicals may be applied at any point in the tissue manufacturing process. This includes pre-treatment of pulp, co-application in the wet end of the process, post treatment after drying but on the tissue machine and topical post treatment.

The number of plies of the products of this disclosure can be two, three, four, five or more. The various plies can be the same or different. For example, if a three-ply tissue is being made, the two outer plies can include virgin fiber, pre-consumer recycled fiber, or mixtures thereof and the center ply can include post-consumer recycled fiber.

In the interests of brevity and conciseness, any ranges of values set forth in this specification are to be construed as written description support for claims reciting any sub-ranges having endpoints which are whole number values within the specified range in question. By way of a hypothetical illustrative example, a disclosure in this specification of a range of 1-5 shall be considered to support claims to any of the following sub-ranges: 1-4; 1-3; 1-2; 2-5; 2-4; 2-3; 3-5; 3-4; and 4-5.

These and other modifications and variations to the present disclosure may be practiced by those of ordinary skill in the art, without departing from the spirit and scope of the present disclosure, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the disclosure so further described in such appended claims.

What is claimed:

1. A multiple ply paper product comprising:

a first ply comprising virgin fiber, pre-consumer recycled fiber, or mixtures thereof;

a second ply comprising at least about 30% by weight post-consumer recycled fiber; and a third ply comprising virgin fiber, pre-consumer recycled fiber, or mixtures thereof, wherein the average pore size distribution of said first ply is greater than the average pore size distribution of said second ply and the average pore size distribution of said third ply.

2. A multiple ply paper product as in claim 1 wherein the wet out time of said second ply is about 50% or greater than the wet out time of said first or third ply.

3. A multiply paper product as in claim 1 wherein the wet out time of said second ply is about 100% to about 1000% greater than the wet out time of said first or third ply.

4. The multiple ply paper product of claim 1 wherein said product is a facial tissue.

5. A multiple ply paper product as in claim 1, wherein said second ply comprises at least about 50% by weight post-consumer recycled fiber.

6. A multiple ply paper product as in claim 1, wherein said second ply comprises at least about 80% by weight post consumer recycled fiber.

7. A multiple ply product as in claim 1 wherein said first and third plies comprise layered sheets and wherein the outer facing layer of said first and third plies comprise primarily hardwood fibers.

8. A multiple ply paper product as in claim 1, wherein said first ply comprises at least about 50% by weight pre-consumer recycled fiber.

9. A multiple ply paper product as in claim 1, wherein said second ply has an average absorbent capacity of from about 1 g/g to about 7 g/g.

10. A multiple ply paper product as in claim 1, wherein said first ply and said third ply have an average absorbent capacity of from about 6 g/g to about 9 g/g.

11. A multiple ply paper product as in claim 10, wherein said second ply is located between said first ply and said third ply.

12. The multiple ply paper product of claim 1 wherein said second ply has a geometric mean tensile strength less than the geometric mean tensile strength of said first or third ply.

13. The multiple ply paper product of claim 12 wherein said second ply has a geometric mean tensile strength of from about 10% to about 50% less than the geometric mean tensile strength of said first or third ply.

14. A multiple ply product of claim 1 wherein said second ply has a caliper less than the caliper of said first or third ply.

15. A multiple ply product of claim 1 wherein the caliper of said second ply is from about 10% to about 40% less than the caliper of the first or third ply and wherein the basis weight of said second ply is equal to or greater than the basis weight of the first or third ply.

16. A process for producing a multiple ply paper product comprising:

forming a first ply paper web comprising at least about 30% by weight post-consumer recycled fiber;

joining said first ply paper web to a second ply paper web comprising virgin fiber, pre-consumer recycled fiber, or mixtures thereof, wherein the average pore size distribution of said first ply is greater than the average pore size distribution of said second ply; and joining said first ply paper web to a third ply paper web comprising virgin fiber, pre-consumer recycled fiber, or mixtures thereof, wherein the average pore size distribution of said first ply is greater than the average pore size distribution of said third ply.

17. A process as in claim 16, wherein said second ply comprises at least about 50% by weight post-consumer recycled fiber.

18. A process as in claim 16, wherein said first ply is laminated to said second ply.

19. A process as in claim 16, wherein said first ply is crimped to said second ply.

* * * * *